US011953290B2

(12) United States Patent
Chernik

(10) Patent No.: US 11,953,290 B2
(45) Date of Patent: Apr. 9, 2024

(54) RETICLE LEVELING SYSTEM

(71) Applicant: New Revo Brand Group, LLC, Plymouth, MN (US)

(72) Inventor: Ryan Chernik, New Brighton, MN (US)

(73) Assignee: NEW REVO BRAND GROUP, LLC, Plymouth, MN (US)

( * ) Notice: Subject to any disclaimer, the term of this patent is extended or adjusted under 35 U.S.C. 154(b) by 881 days.

(21) Appl. No.: 17/013,940

(22) Filed: Sep. 8, 2020

(65) Prior Publication Data

US 2022/0074708 A1 Mar. 10, 2022

(51) Int. Cl.
*F41G 1/54* (2006.01)
*F41G 1/26* (2006.01)
*F41G 11/00* (2006.01)

(52) U.S. Cl.
CPC ..... *F41G 1/54* (2013.01); *F41G 1/26* (2013.01); *F41G 11/003* (2013.01)

(58) Field of Classification Search
CPC ..... F41G 1/54; F41G 1/26; F41G 11/003
See application file for complete search history.

(56) References Cited

U.S. PATENT DOCUMENTS 4,095,347 A * 6/1978 Steffan ..... F41G 1/54 33/295
4,530,162 A * 7/1985 Forrest ..... F41G 1/54 33/228
5,001,836 A * 3/1991 Cameron ..... F41G 1/54 42/116
5,060,391 A * 10/1991 Cameron ..... F41G 3/323 42/115
5,222,302 A * 6/1993 DeBatty ..... F41G 1/54 42/121
5,396,708 A * 3/1995 Whitley ..... F41G 3/323 279/2.12
5,440,134 A * 8/1995 Lough ..... F41G 1/54 250/504 R (Continued)

OTHER PUBLICATIONS https://www.realavid.com/2020/06/18/level-your-reticle-right/ (From Real Avid monthly archives dated Jun. 18, 2020) (Year: 2020).*

(Continued)

*Primary Examiner* — Michelle Clement
(74) *Attorney, Agent, or Firm* — GRUMBLES LAW PLLC; Brittany Haanan

(57) ABSTRACT

A reticle leveling system can include a firearm mount having a base mount, track, scope saddle, and light projector. The system can further include a tripod and an alignment grid. The firearm mount can attach to an elongated portion of a firearm, such as a barrel or picatinny rail. The base mount and track can secure the firearm mount to the elongated portion of the firearm, and the scope saddle can align on top of the scope, thereby creating connection points on both the elongated portion and the scope. The light projector can shine light through the front of the scope, thereby causing scope reticle to project out of the eyepiece. The projected image of the reticle can be shown on the alignment grid, which can be attached to the top of the tripod, and the alignment grid can include cross-hatching to illustrate whether the reticle is properly aligned.

20 Claims, 11 Drawing Sheets

(56) References Cited

U.S. PATENT DOCUMENTS

| | | | | |
|---|---|---|---|---|
| 5,499,455 | A * | 3/1996 | Palmer | F41G 1/545 42/122 |
| 5,878,504 | A * | 3/1999 | Harms | F41G 1/545 33/286 |
| 6,176,019 | B1 * | 1/2001 | Frear, Jr. | F41G 3/323 42/120 |
| 6,176,169 | B1 * | 1/2001 | Rostocil | F41A 3/36 89/33.14 |
| 6,513,275 | B1 * | 2/2003 | Paige | F41G 3/323 42/130 |
| 6,609,325 | B2 | 8/2003 | Harris | |
| 6,813,855 | B2 * | 11/2004 | Pinkley | G02B 27/36 33/286 |
| 6,862,833 | B1 | 3/2005 | Gurtner | |
| 8,561,341 | B1 * | 10/2013 | Dihlmann | F41G 1/545 42/126 |
| 8,800,154 | B2 | 8/2014 | Schmidt | |
| 9,115,957 | B1 * | 8/2015 | Winker | F41G 3/323 |
| 9,255,770 | B1 * | 2/2016 | DiCorte | F41G 1/35 |
| 9,377,273 | B1 * | 6/2016 | Loper | F41G 1/545 |
| 9,500,443 | B2 * | 11/2016 | McCoy, II | F41G 1/44 |
| 9,846,010 | B2 * | 12/2017 | Pasfield | F41G 1/545 |
| 10,648,773 | B2 * | 5/2020 | Owens | F41G 1/38 |
| 10,914,553 | B2 * | 2/2021 | McCoy, II | F41G 1/54 |
| 11,199,378 | B2 * | 12/2021 | LoRocco | F41G 1/545 |
| 11,365,968 | B2 * | 6/2022 | McCoy, II | G01C 9/28 |
| 11,415,393 | B2 * | 8/2022 | Coil | F41G 1/545 |
| 2003/0131517 | A1 * | 7/2003 | Paige | F41G 3/323 42/134 |
| 2007/0009860 | A1 * | 1/2007 | Young | F41G 3/2655 434/21 |
| 2013/0283661 | A1 * | 10/2013 | Lynn | F41G 1/383 42/114 |
| 2015/0345905 | A1 * | 12/2015 | Hancosky | F41G 1/545 42/113 |
| 2016/0245621 | A1 * | 8/2016 | Kintzing | F41G 11/003 |
| 2018/0274886 | A1 * | 9/2018 | Goddard | F41G 1/545 |

OTHER PUBLICATIONS

REAV-Level-Right-Pro_Sheet (Year: 2020).* https://www.realavid.com/2020/06 (showing date when level-your-reticle right was dated) (Year: 2020).*

Weaver Gunsmith 849724 Modular Scope Level System Easy Use/Extremely reliable. Website. Retrieved Dec. 2020. https://www.amazon.com/Weaver-Gunsmith-Modular-Level-System/dp/B003BRY1UY/ref=sr_1_69?dchild=1&keywords=scope+level&qid=1602517346&s=sporting-goods&sr=1-69.

Wheeler Engineering Professional Reticle Leveling System with Heavy-Duty Construction, Universal Design and Storage Case for Gunsmithing and Maintenance. Website. Retrieved Dec. 2020. https://www.amazon.com/Wheeler-Engineering-Professional-Construction-Gunsmithing/dp/B004TAB7ZO#:~: text=The%20Wheeler%20professional%20reticle%20leveling, a%20class%20of%20its%20own.

XAegis Rifle Scope Boresighter Kit-Precision Firearm Bore Sighter Kit with Arbors. Website. Retrieved Dec. 2020. https://www.amazon.com/XAegis-Boresighter-Kit-Precision-Firearm-Sighter/dp/B06XHGQV21.

Wheeler Engineering Scope Mounting Leveling Tool and Caldwell Steady Rest. Website. Retrieved Dec. 2020. https://www.amazon.com/Wheeler-Engineering-Mounting-Leveling-Caldwell/dp/B07YXCS8SD.

EXD Engineering—Vertical Reticle Instrument. Website. Retrieved Dec. 2020. https://www.brownells.com/gunsmith-tools-supplies/sight-scope-installation-tools/scope-reticle-levelers/vertical-reticle-instrument-prod6097.aspx.

Pursuit Boresighter Kit. Website. Retrieved Dec. 2020. https://www.basspro.com/shop/en/pursuit-boresighter-kit.

SRL—100 Scope Reticle Leveler. Website. Retrieved Dec. 2020. https://sitelite-lasers.com/product_SRL100.html.

The Segway Reticle Leveler. Website. Retrieved Dec. 2020. http://www.straightshotllc.com/.

* cited by examiner

RETICLE LEVELING SYSTEM

FIELD OF THE INVENTION

This disclosure relates to firearm maintenance aids, and more particularly, relates to tools for leveling and aligning scopes on a firearm.

BACKGROUND OF THE INVENTION

Scopes are used on firearms to aid in aiming the firearm and in some cases, to magnify a target. Proper aim is critical to ensure an accurate shot is taken. A standard scope includes windage and elevation adjustments, an aiming reticle, an ocular lens on a first end of the scope into which a user looks, an objective lens on a second end of the scope, scope rings to connect to the scope to the firearm, and magnification and quick focus rings on the first end of the scope. To aim the gun, the target is aligned with the front sight and the front sight is aligned within the notch of the rear sight.

If the gun is not properly sighted, the user's aim will be inaccurate. Further, in some cases, individuals may desire a different type of sight and may therefore need to replace the sight that is currently on their gun. Therefore, there are times when a gun sight will need to be adjusted or replaced, and a device is needed that can facilitate these activities.

SUMMARY OF THE INVENTION

This disclosure relates to firearm maintenance aids, and more particularly, relates to tools for leveling and aligning scopes on a firearm. In an illustrative but non-limiting example, the disclosure provides a reticle leveling system that can include a base mount structured and configured to mount to a firearm; a track removably attached to the base mount, the track having a level; a scope saddle that is vertically adjustable on the track; and a light projector attached to the scope saddle.

In some examples, a back of the track can be attached to a front end of the base mount. Further a back of the scope saddle may be attached to the front of the track, and the light projector can attach to the scope saddle through an opening in the track. In some cases, the light projector can align with a front of a scope of the firearm and project an image of the reticle out through an eyepiece of the scope.

In some examples, the base mount may be mounted to an elongated portion of the firearm in front of a scope of the firearm using at least one pair of magnets located on an underside of the base mount. Further, the elongated portion of the firearm may be a barrel of the firearm, and a pair of magnets may be located on opposing sides of the barrel. More specifically, the base mount can include two pairs of magnets located on the underside of the base mount, the first pair being located at a first end of the base mount and the second pair being located at a second, opposite end of the base mount. Alternatively, the base mount may be mounted to an elongated portion of the firearm in front of a scope of the firearm using a side clamp screw, and the side clamp screw can be structured and configured to tighten the base mount onto the elongated portion of the firearm.

In some examples, the track can be removably attached to the base mount using slidable track guides on either side of the base mount. And in some cases, the scope saddle can slide vertically up and down the track. More specifically, the scope saddle can include a scope saddle mount having angled surfaces that engage an outer diameter of a scope of the firearm. Further, the scope saddle also includes a scope saddle faceplate that is flush with a front face of the scope. The base mount may additionally include a rear height adjustment screw that enables a rear end of the base mount to vertically adjust to ensure the scope saddle faceplate can be made flush with the front face of the scope.

In some examples, the reticle leveling system further includes a tripod; and an alignment grid attached to a top of the tripod, wherein the light projector can align with a front of a scope of the firearm and project an image of the reticle out through an eyepiece of the scope, and wherein the alignment grid can be in horizontal alignment with the scope of the firearm. In some cases, the alignment grid can include cross-hatching in a color other than red.

In another illustrative but non-limiting example, the disclosure provides a reticle leveling system that can include a base mount structured and configured to mount to an elongated portion of a firearm; a track removably attached to a front end of the base mount, the track having a level; a scope saddle that is slidingly adjustable along a vertical portion of the track and that engages an outer diameter of a scope of the firearm; and a light projector attached to the scope saddle through an opening in the track.

In another illustrative but non-limiting example, the disclosure provides a method for leveling a scope of a firearm, the method including the steps of attaching a track to a base mount; securing the base mount to an elongated portion of the firearm; sliding a scope saddle along the track until the scope saddle engages an outer diameter of the scope of the firearm; and activating a light projector that is attached to the scope saddle and aligned with a front of the scope of the firearm to project an image of a scope reticle out through an eyepiece of the scope. The light projector may include a light projector focus and a ribbed collar, wherein the ribbed collar can attach to the scope saddle, and wherein the angle of light from the light projector can be adjusted by pushing, pulling, and rotating the light projector focus.

In some cases, the method further includes the steps of leveling the firearm using a level attached to a top of the track; attaching an alignment grid to a top of a tripod; leveling the alignment grid using a second level attached to a top of the alignment grid; aligning the image of the scope reticle on the alignment grid; and rotating the scope to match reticle lines of the scope reticle with graph lines on the alignment grid.

In some cases, the elongated portion of a firearm can be a barrel and a bottom of the base mount can include at least one pair of magnets to secure the base mount to the barrel. In other cases, the elongated portion of a firearm can be a rail and the base mount can include a side clamp screw that pulls together two opposing sides of the base mount to secure the base mount to the rail.

The above summary is not intended to describe each and every example or every implementation of the disclosure. The description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
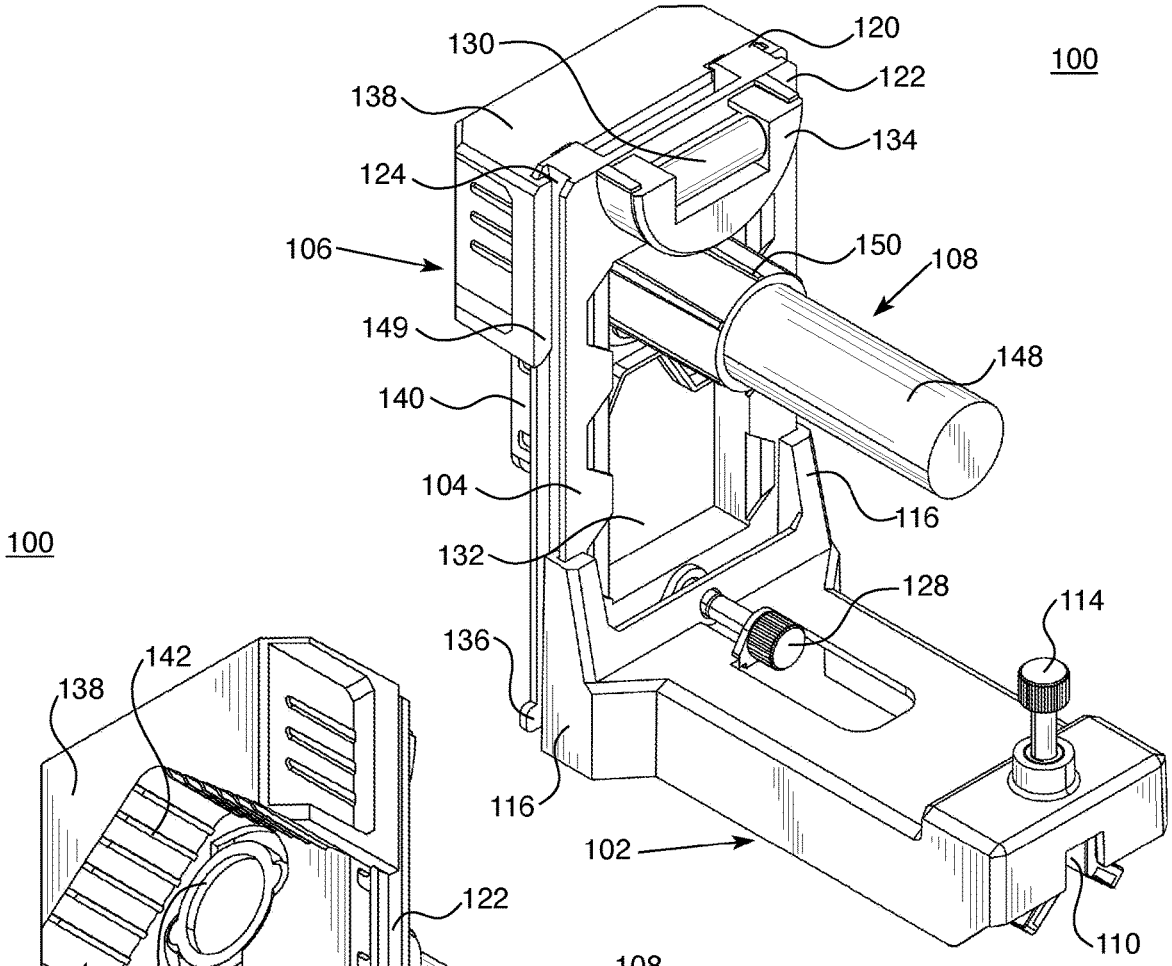
FIG. 1 is a perspective back view of a firearm mount of a reticle leveling system of the present disclosure.

The present disclosure relates to firearm maintenance aids, and more particularly, relates to tools for leveling and aligning scopes on a firearm. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Figure 4:
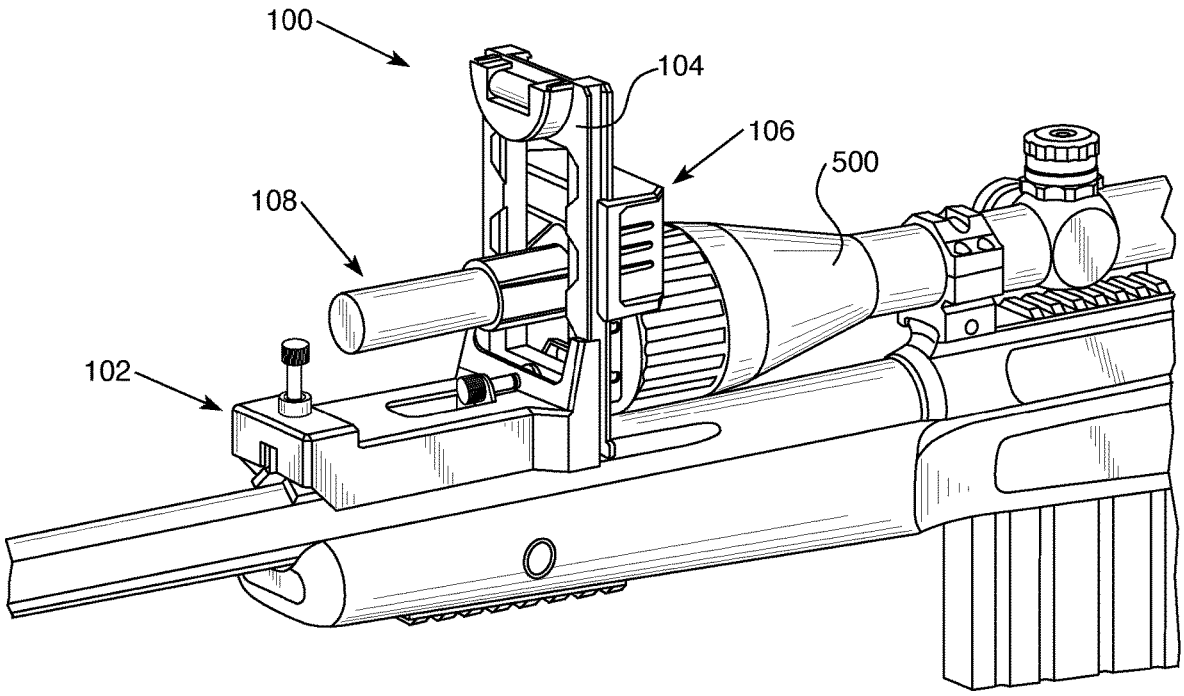
FIG. 4 is a perspective back view of the firearm mount of FIG. 1 engaged with a firearm.
Figure 5:
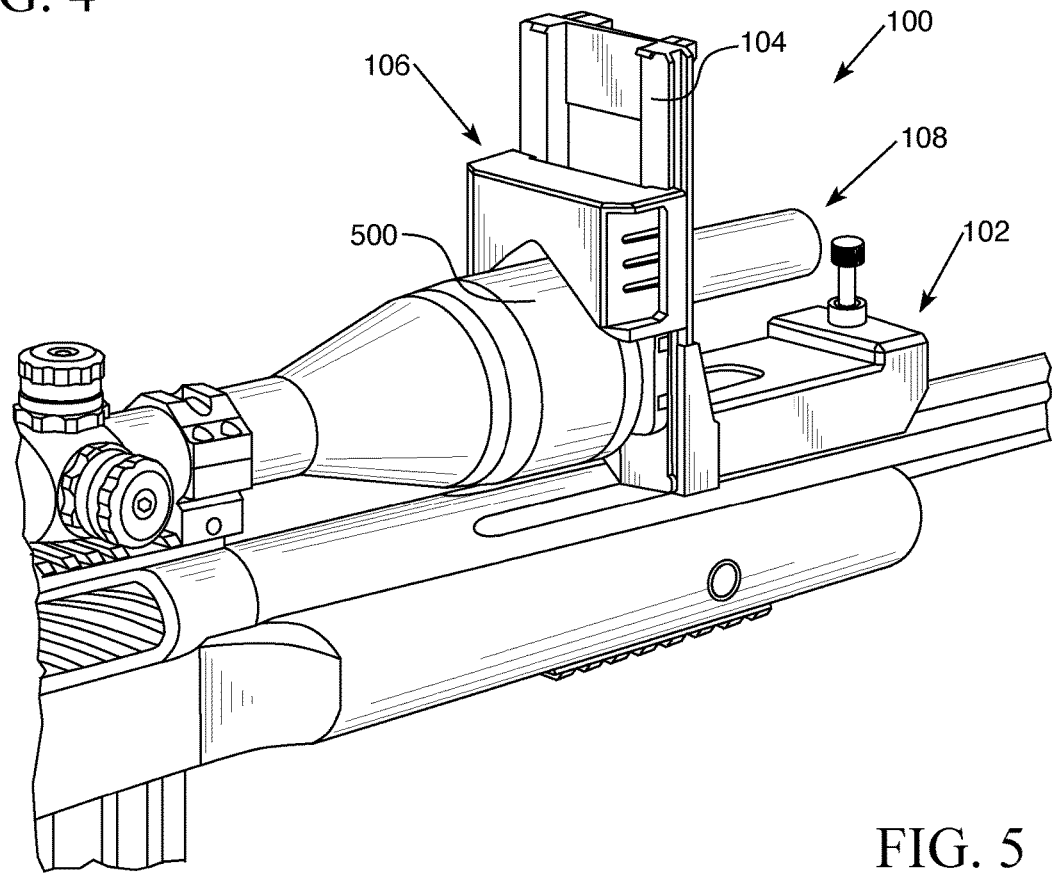
FIG. 5 is a perspective front view of the firearm mount of FIG. 1 engaged with a firearm.
Figure 7:
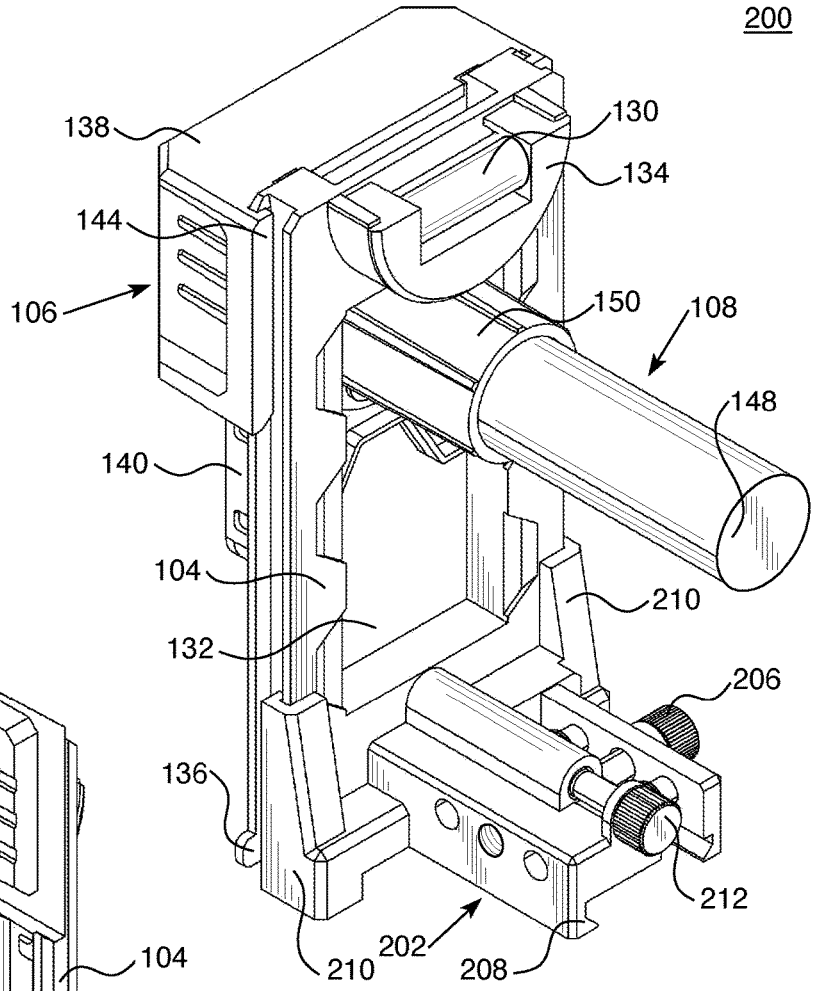
FIG. 7 is a perspective back view of a second embodiment of a firearm mount of a reticle leveling system of the present disclosure.
Figure 10:
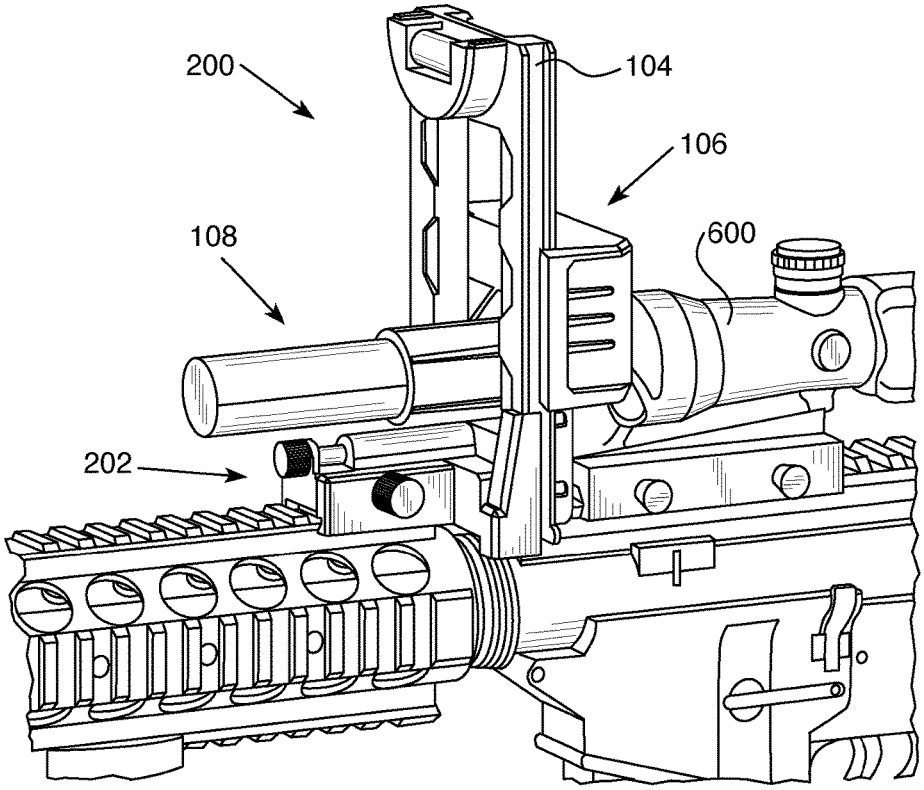
FIG. 10 is a perspective back view of the firearm mount of FIG. 7 engaged with a firearm.
Figure 11:
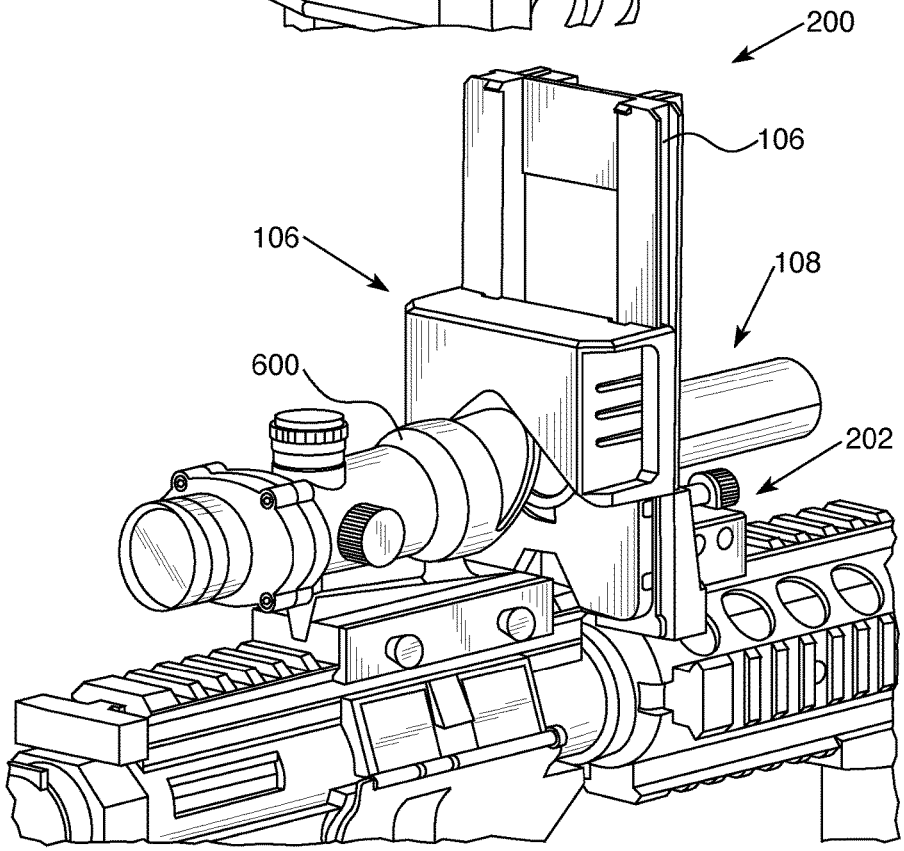
FIG. 11 is a perspective front view of the firearm mount of FIG. 7 engaged with a firearm.
Figure 13:
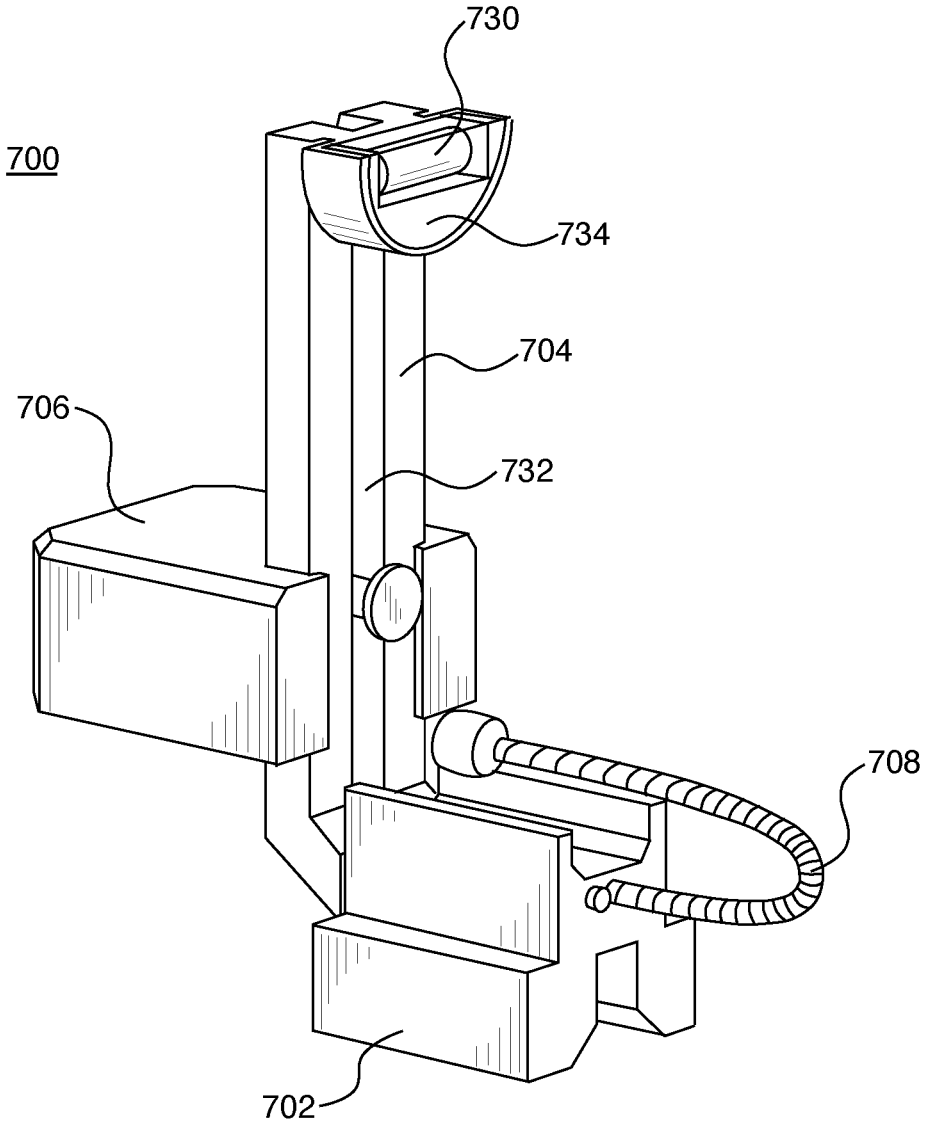
FIG. 13 is a perspective back view of a third embodiment of a firearm mount of a reticle leveling system of the present disclosure.
Figure 14:
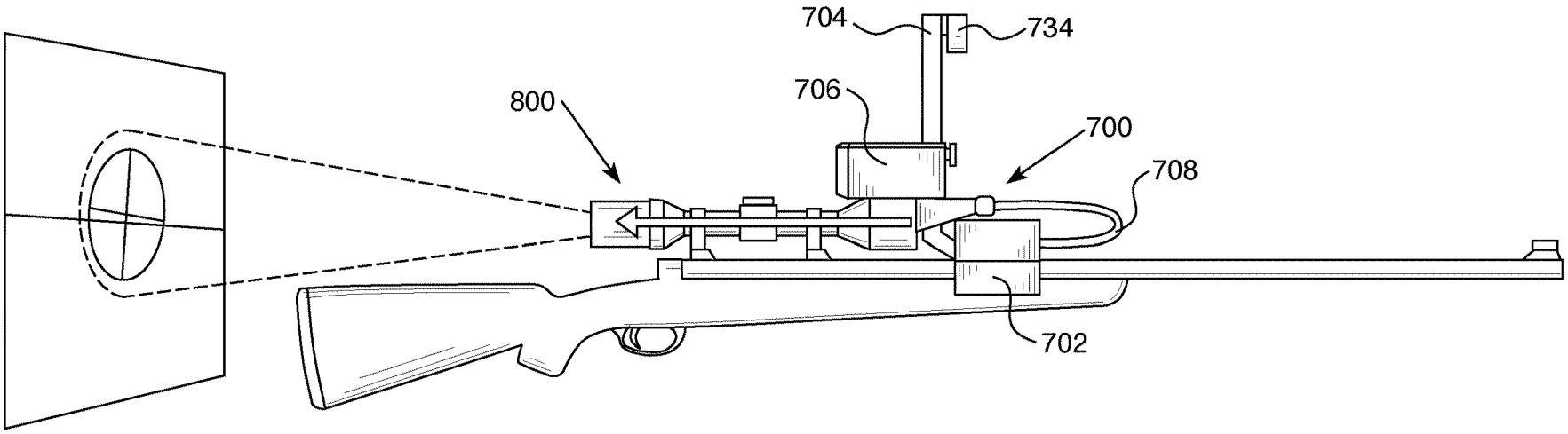
FIG. 14 is a side view of the reticle leveling system having the firearm mount of FIG. 13 engaged with a firearm and in use.

FIGS. 1, 7, and 13 are perspective back views of examples of firearm mounts of a reticle leveling system. Firearm mount 100, as illustrated in FIG. 1, can include base mount 102, track 104, scope saddle 106, and light projector 108. Firearm mount 200, as illustrated in FIG. 7, can include base mount 202, track 104, scope saddle 106, and light projector 108. Firearm mount 700, as illustrated in FIG. 13, can include base mount 702, track 704, scope saddle 706, and light projector 708. Track 104 can attach to base mount 102 or 202, which can engage with an elongated portion of a firearm in front of firearm scope 500, 600, as illustrated in FIGS. 4-5 and 10-11. Similarly, track 704 can attach to base mount 702, which can engage with an elongated portion of a firearm in front of firearm scope 800, as illustrated in FIG. 14. Scope saddle 106 can be vertically adjustable on track 104 and can include a scope saddle mount, which can have angled surfaces that engage with an outer diameter of scope 500, 600, as illustrated in FIGS. 5 and 11.

Figure 2:
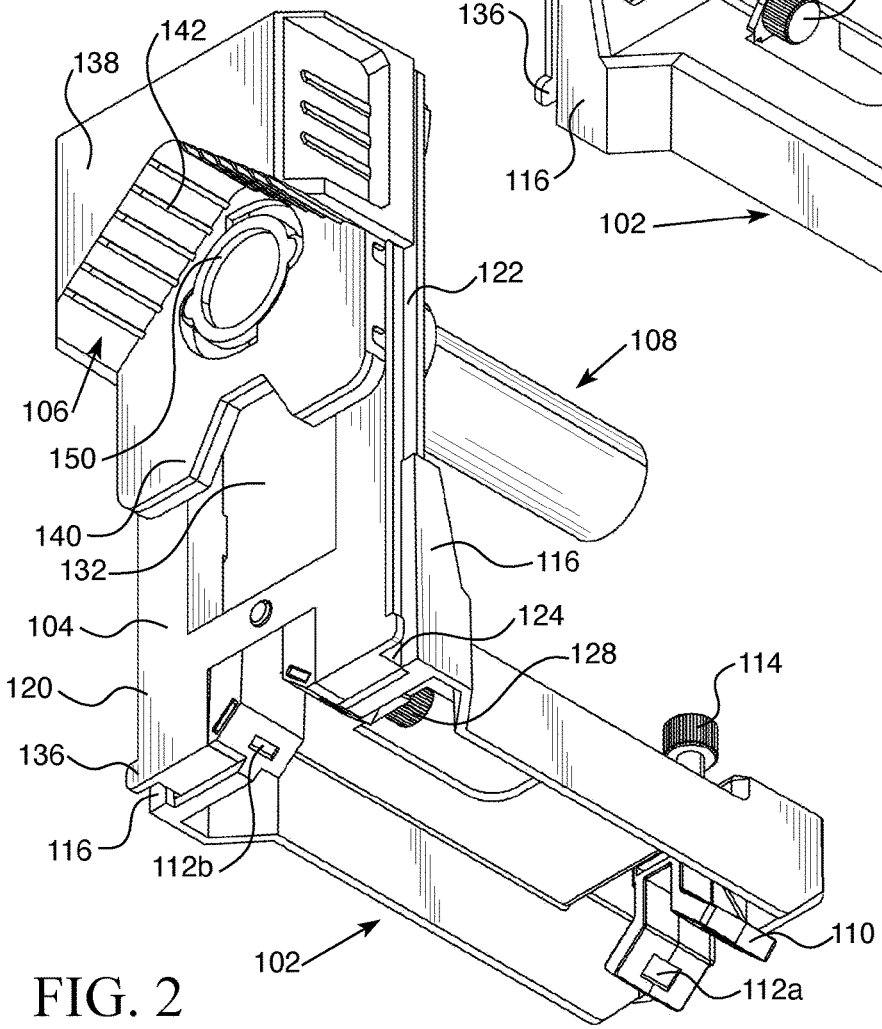
FIG. 2 is a perspective front view of the firearm mount of FIG. 1.
Figure 3:
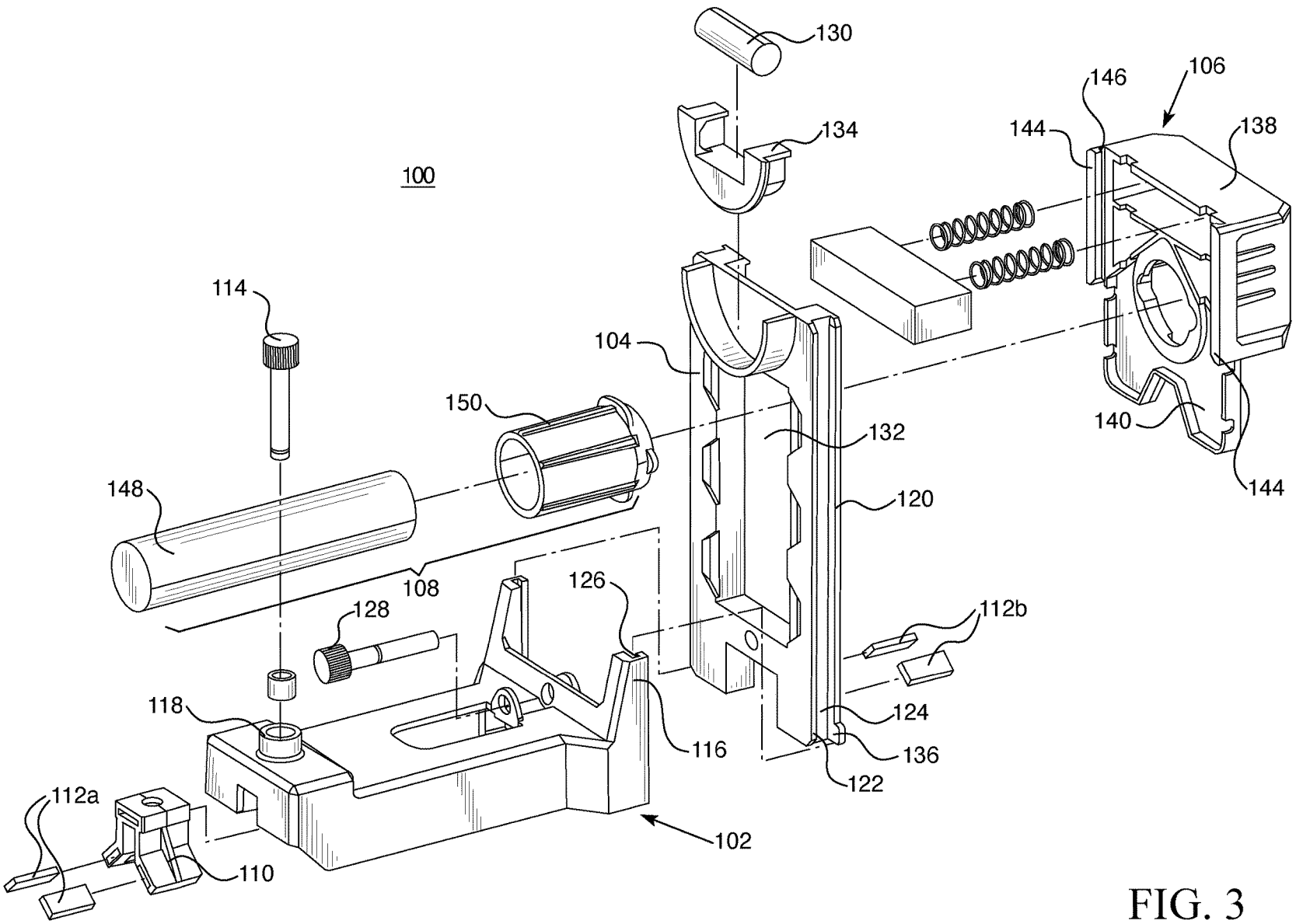
FIG. 3 is an exploded view of the firearm mount of FIG. 1.
Figure 6:
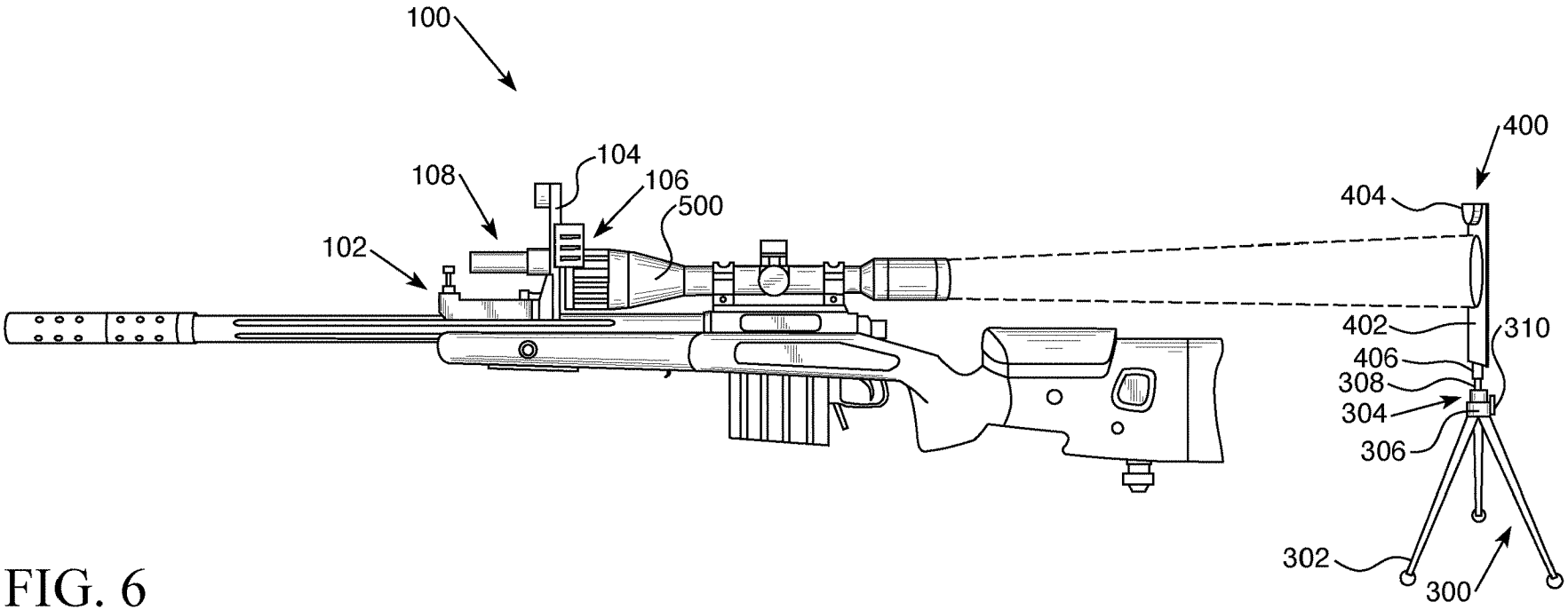
FIG. 6 is a side view of the reticle leveling system having the firearm mount of FIG. 1 engaged with a firearm and in use.
Figure 8:
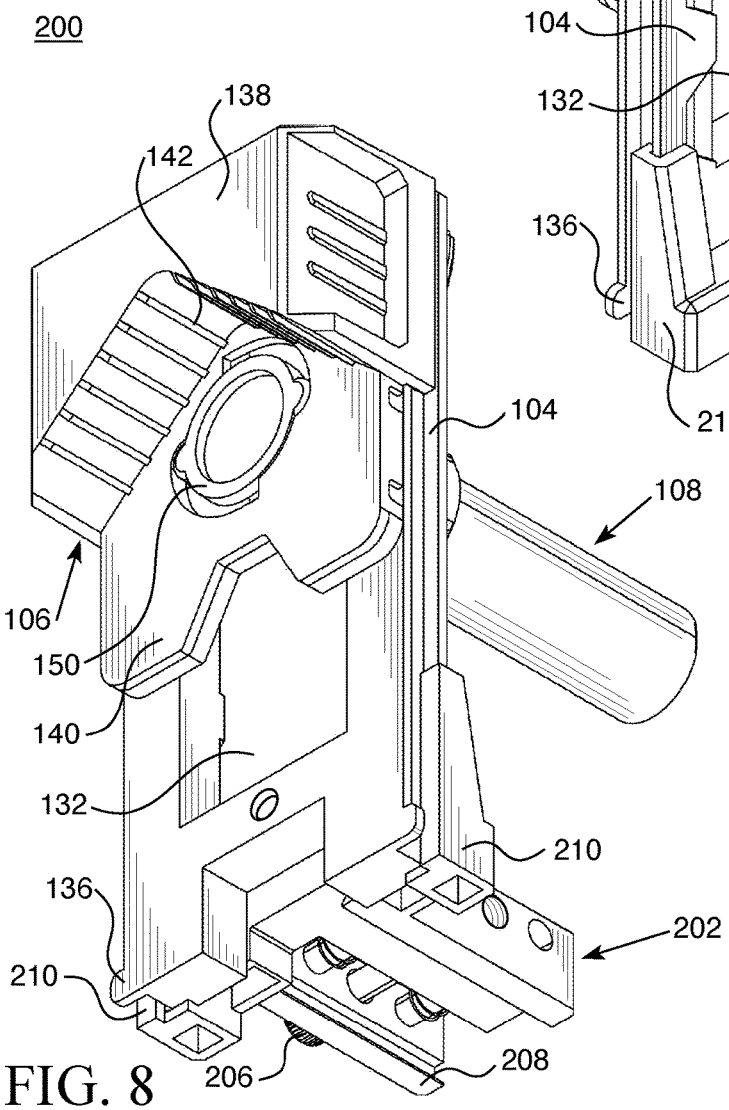
FIG. 8 is a perspective front view of the firearm mount of FIG. 7.
Figure 9:
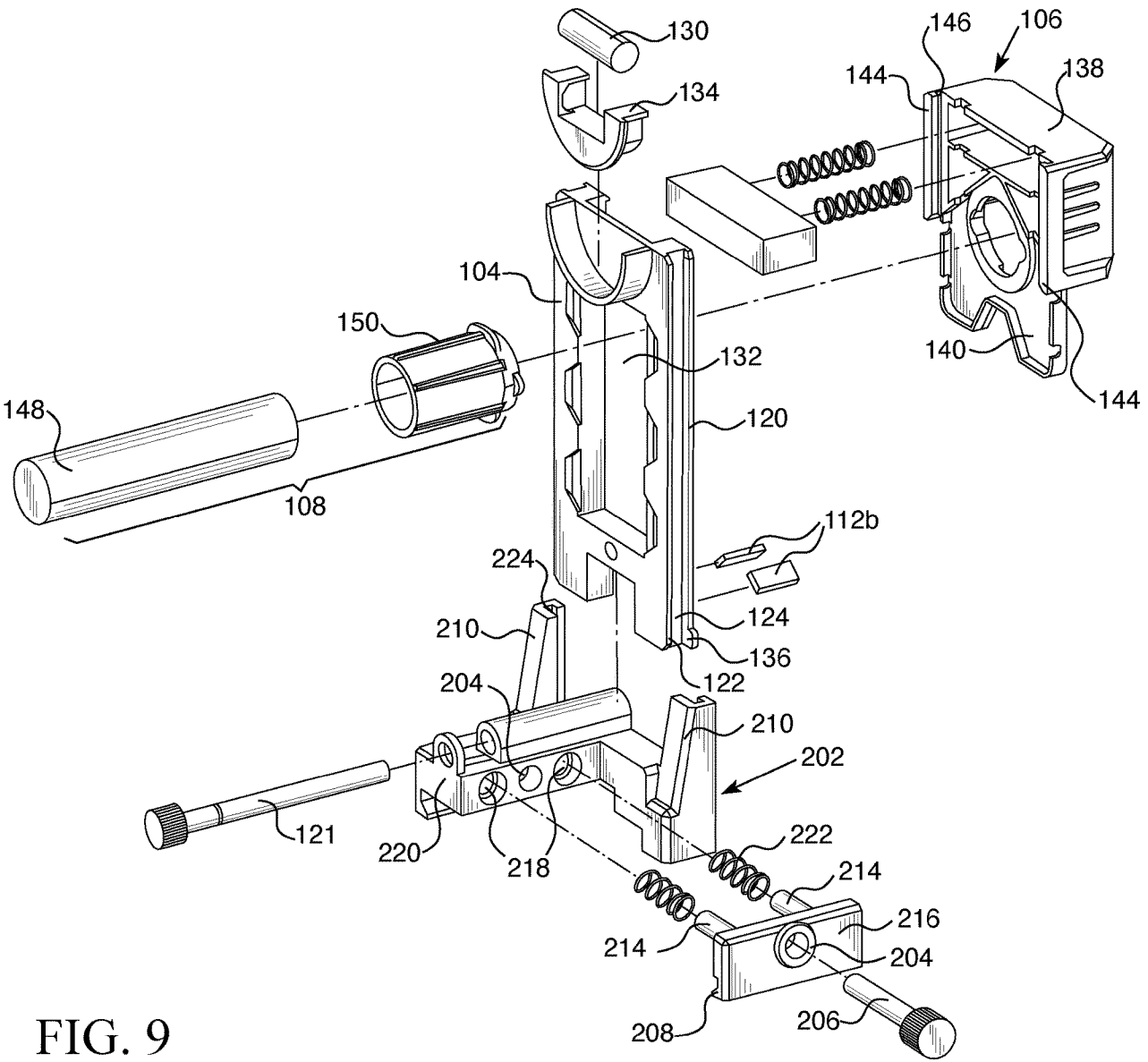
FIG. 9 is an exploded view of the firearm mount of FIG. 7.
Figure 12:
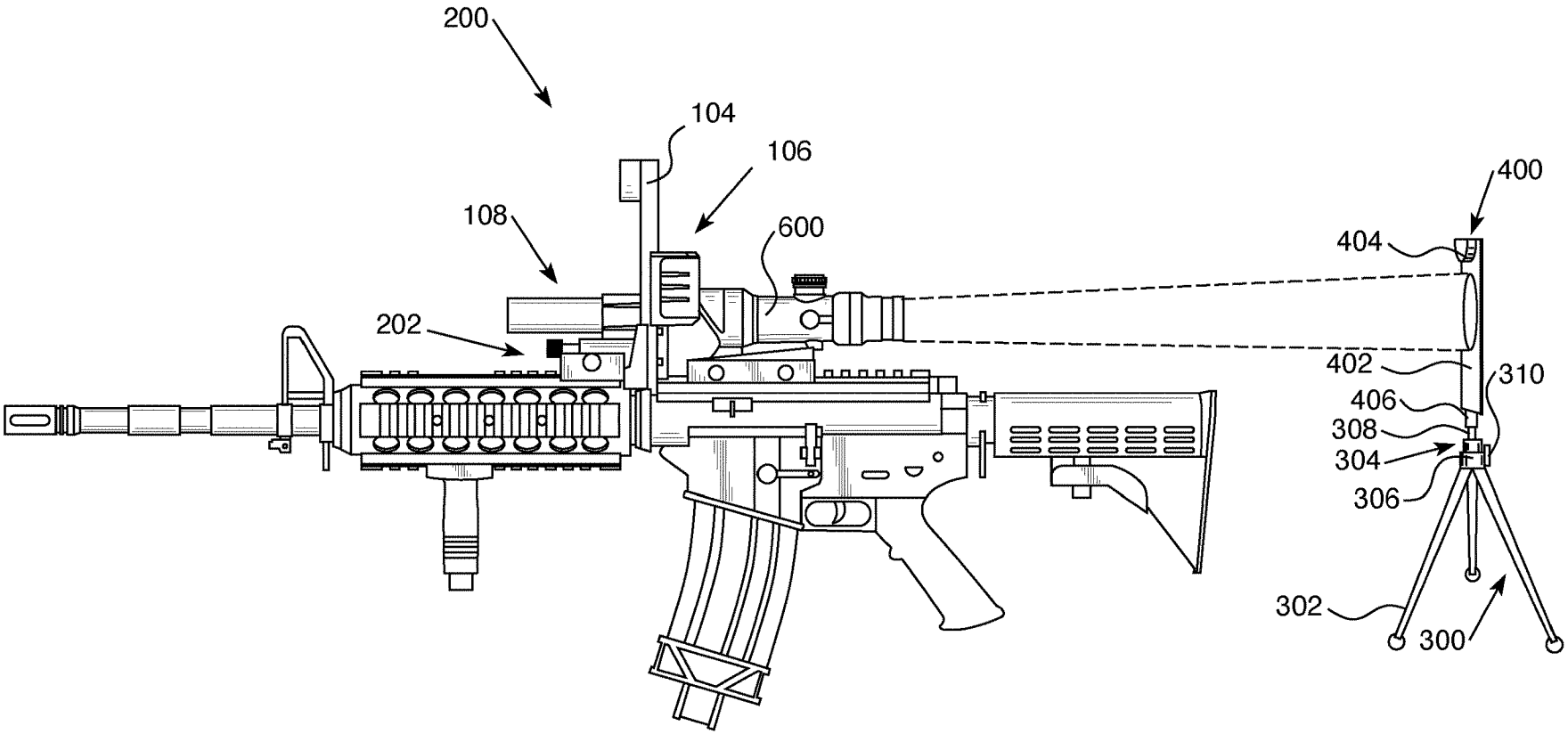
FIG. 12 is a side view of the reticle leveling system having the firearm mount of FIG. 7 engaged with a firearm and in use.
Figure 15:
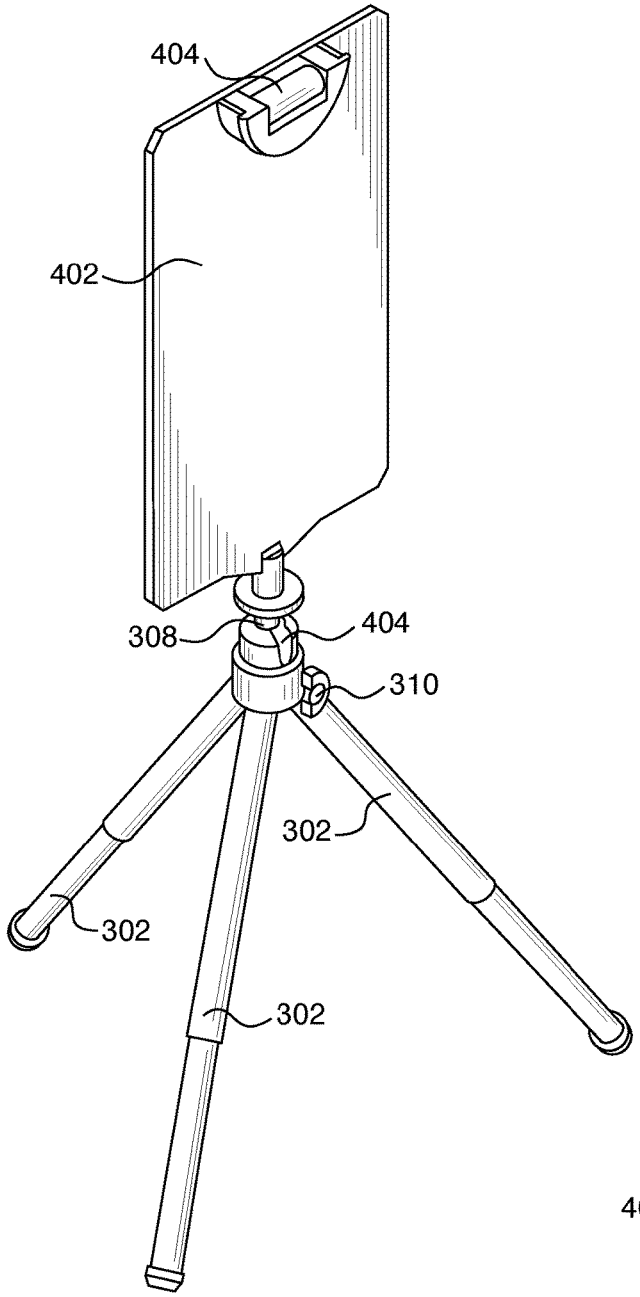
FIG. 15 is a perspective front view of a tripod and alignment grid of a reticle leveling system of the present disclosure.
Figure 16:
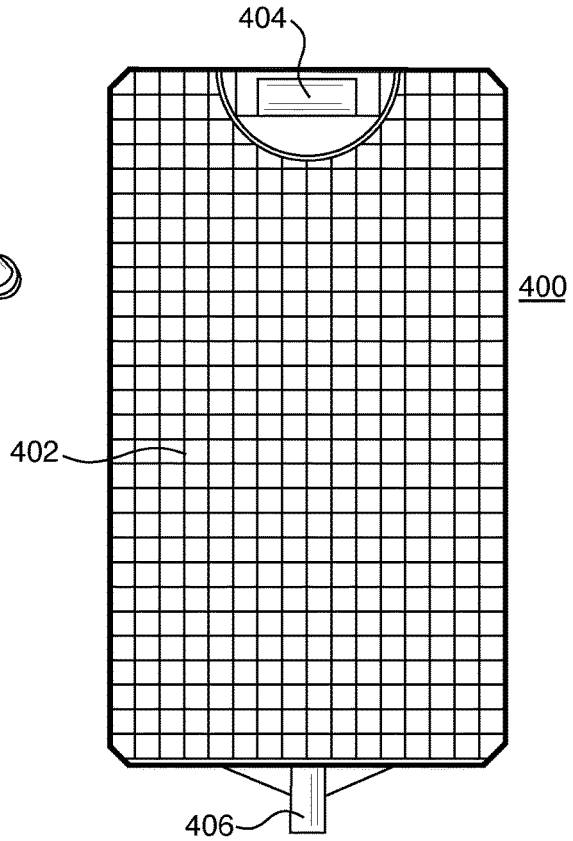
FIG. 16 is a front view of an alignment grid of a reticle leveling system of the present disclosure.

Additional views of the reticle leveling system are provided. FIG. 2 is a perspective front view of firearm mount 100. FIG. 3 is an exploded view of firearm mount 100. FIG. 4 is a perspective back view of firearm mount 100 engaged with a firearm. FIG. 5 is a perspective front view of firearm mount 100 engaged with a firearm. FIG. 6 is a side view of the reticle leveling system having firearm mount 100 engaged with a firearm and in use. FIG. 8 is a perspective front view of firearm mount 200. FIG. 9 is an exploded view of firearm mount 200. FIG. 10 is a perspective back view of firearm mount 200 engaged with a firearm. FIG. 11 is a perspective front view of firearm mount 200 engaged with a firearm. FIG. 12 is a side view of the reticle leveling system having firearm mount 200 engaged with a firearm and in use. FIG. 14 is a side view of the reticle leveling system having firearm mount 700 engaged with a firearm and in use. FIG. 15 is a perspective front view of tripod 300 and alignment grid 400. FIG. 16 is a front view of alignment grid 400.

Firearm mount 100, 200, 700 can generally be comprised of rigid materials such that the firearm mount cannot be folded, bent, or otherwise forced out of shape. Examples of materials used for firearm mount 100, 200, 700 include, but are not limited to, metal (for example, aluminum, steel, iron, brass, copper, etc.), plastic (for example, high-density polyethylene, polyvinyl chloride, polypropylene, other thermoplastic polymers, etc.), high durometer rubber, and combinations thereof.

As mentioned above, the reticle leveling system can include a firearm mount having a base mount, track, scope saddle, and light projector. Additionally, the reticle leveling system can include a tripod and an alignment grid. Generally, the firearm mount can attach to an elongated portion of a firearm, such as a barrel or picatinny rail, on a front side of a scope of the firearm. The base mount and track are structured and configured to secure the firearm mount to the elongated portion of the firearm, and the scope saddle is structured and configured to align on top of the scope, thereby creating connection points on both the elongated portion and the scope. The light projector is structured and configured to shine a light through the front of the scope, thereby causing the reticle of the scope to project out of the eyepiece of the scope. The projected image of the reticle can be shown on the alignment grid, which can be attached to the top of the tripod, and the alignment grid can include cross-hatching to illustrate whether the reticle is properly aligned or not.

The firearm mount of the reticle leveling system can be compatible with multiple types of firearms. More specifically, the base mount of the firearm mount may be interchangeable with the remaining components of the firearm mount such that a first base mount is structured and configured to engage with a barrel and a second base mount is structured and configured to engage with a picatinny rail. The remaining components of the firearm mount (the track, scope saddle, and light projector) and reticle leveling system (the tripod and alignment grid) may remain consistent between embodiments and, therefore, be compatible with both the first base mount and the second base mount. Throughout this disclosure, unless otherwise noted, examples provided of the firearm mount are applicable to embodiments using either base mount.

Therefore, in one embodiment, the reticle leveling system includes firearm mount 100, tripod 300, and alignment grid 400, as illustrated in FIG. 6. In another embodiment, the reticle leveling system includes firearm mount 200, tripod 300, and alignment grid 400, as illustrated in FIG. 12. In yet another embodiment, the reticle leveling system includes firearm mount 700, tripod 300, and alignment grid 400.

Firearm mount 100, as mentioned above, can include base mount 102, track 104, scope saddle 106, and light projector 108. Similarly, firearm mount 200 can include base mount 202, track 104, scope saddle 106, and light projector 108, and firearm mount 700 can include base mount 702, track 704, scope saddle 706, and light projector 708. Base mount 102, 202, 702 can be structured and configured to mount to a firearm. Track 104 (or 704) can be removably attached to base mount 102, 202 (or 702) and can include a level. Scope saddle 106 can be vertically adjustable on track 104, and light projector 108 can be attached to the scope saddle. Alternatively, scope saddle 706 can be vertically adjustable on track 704, and light projector 708 can be attached to base mount 702. Generally, the rear of the various components of the firearm mount are positioned nearer to the front of the firearm while the front of each component is positioned closer to the scope of the firearm.

Base mount 102 may be elongated and roughly rectangular in shape, as illustrated in FIGS. 1-2. A rear portion of base mount 102 may include rear magnet housing 110 having magnets 112*a* and rear height adjustment screw 114 connected to the rear magnet housing. Base mount 102 may also include track guides 116 near a front portion that include embedded magnets 112*b*.

Rear magnet housing 110 can be located underneath base mount 102 and can house magnets 112*a*, as illustrated in FIG. 2. In some embodiments, rear magnet housing 110 can have two sides that extend downward from base mount 102 and that each house magnet 112*a* at or near their bottommost ends. Further, the two sides can splay out from each other as they extend downward such that the tops of the two sides are closer to each other than the bottoms of the two sides. In this manner, the two sides create an engagement section, or saddle, for base mount 102 to engage with the elongated portion of the firearm. For example, if base mount 102 is being mounted to a barrel, the interior faces of the two sides of rear magnet housing 110 can straddle and make contact with opposing sides of the barrel, as illustrated in FIG. 4. Since firearm barrels are typically comprised of a metal (i.e., magnetic) material, magnets 112*a* at or near the bottommost ends of the sides of rear magnet housing 110 can engage with the barrel, therefore securing base mount 102 on top of the barrel of the firearm. Similarly, magnets 112*b* at near the bottommost ends of track guides 116 of base mount 102 can engage with the barrel, helping to secure the base mount on top of the barrel of the firearm.

Rear height adjustment screw 114 may be perpendicular to and run through elongated base mount 102 and connect on its bottommost end to rear magnet housing 110. Adjustment screw 114 can be threaded, and adjustment screw receiver 118 of base mount 102 can be threaded. Bottom end of adjustment screw 114 may be fixed in place in rear magnet housing 110. Therefore, when adjustment screw 114 is turned in one direction, it can cause base mount 102 to translate along the adjustment screw, which lifts the rear portion of the base mount up. When adjustment screw 114 is turned in an opposite direction, it can cause base mount 102 to translate along the adjustment screw in the opposite direction, which pulls the rear portion of the base mount down until it makes complete contact with the elongated portion of the firearm. At this point, the rear portion of base mount 102 reaches its lowest point.

As mentioned above, base mount 102 may also include track guides 116. Track guides 116, as illustrated in FIGS. 1-2, can be located on opposite sides of base mount 102 and can have openings that engage with track 104 through, for example, a sliding mechanism. More specifically, and as explained in more detail below, the right and left sides of track 104 may include front and rear rails 120, 122, respectively, having gutter 124 in between the two rails. Additionally, each track guide 116 may include vertical slot 126 that is sized to fit rear rails 122 such that when the rail engages with the vertical slot, it is secured in place via a friction fit. Therefore, in use, the rear left and rear right rails 122 of track 104 can slide into vertical slots 126 of left and right track guides 116, respectively, as illustrated in FIGS. 1-2.

In some embodiments, to more securely attach track 104 to base mount 102, the base mount may include track attachment screw 128. Track attachment screw 128 can be horizontally and threadedly engaged with both base mount 102 and track 104. More specifically, base mount 102 can include a horizontal, threaded hole in its front portion, and track can include a horizontal, threaded hole that runs from its back to its front. The horizontal, threaded hole of base mount 102 can align with the corresponding horizontal, threaded hole in track 104 when the base mount and the track are slidingly engaged, as described above and illustrated in FIG. 1. To fixedly secure base mount 102 and track 104 together after they are slidingly engaged, track attachment screw 128 can be inserted into the threaded hole of the base mount and into the threaded hole of the track, thereby locking the two components together.

Base mount 202 may be roughly rectangular or square in shape, as illustrated in FIGS. 7-8. The sides of base mount 202 may be separate components and may include aligned side clamp screw holes 204 that are structured and configured to engage with side clamp screw 206, thereby fixing the two sides together. Bottom of base mount 202 may include hooked edges 208 that engage with the rail of a picatinny mount. Base mount 202 may also include track guides 210 near a front portion of the base mount and horizontally engaged track attachment screw 212 that is structured and configured to attach track 104 to the base mount.

In some embodiments, the sides of base mount 202 may be separate pieces that are structured and configured to attach to each other through the use of side clamp screw 206 and side pins 214. More specifically, the sides can be movable relative to each other so as to adjustably increase or decrease the distance between them. In some cases, both sides are movable. In other cases, a first side may be moveable relative to a second side, and the second side can either be a single molded piece with the front of base mount 202, as illustrated in FIG. 9, or it can be fixedly attached to the front of the base mount.

To secure the two sides of base mount 202 together, first side 216 can include one or more side pins 214 that are permanently affixed to an interior face of the first side and that engage with side pin holes 218 in an interior face of second side 220. In some embodiments, resistors 222 (for example, springs) may be paired with side pins 214 so as to resist a decrease in space when first side 216 moves towards second side 220. In this manner, when first side 216 is released, resistors 222 may push the first side further away from second side 220. To move first side 216 and second side 220 closer together, the first and second sides can have aligned side clamp screw holes 204 through which side clamp screw 206 is inserted and tightened. In some cases, side clamp screw holes 204 in both first and second sides 216, 220 may be threaded. In other cases, only one side (for example, second side 220) may be threaded so as to allow the other side (for example, first side 216) to move more freely with side clamp screw 206. The ability to adjustably increase or decrease the distance between first side 216 and second side 220 enables base mount 202 to securely engage with the elongated portion of the firearm using a clamping mechanism. For example, if base mount 202 is being mounted to a picatinny rail, side clamp screw 204 can first be loosened to allow first side 216 and second side 220 to span the width of the picatinny rail and can then be tightened to secure the base mount to the picatinny rail, as illustrated in FIG. 10.

To further secure base mount 202 to the elongated portion of the firearm, the bottom of base mount may include hooked edges 208, as illustrated in FIG. 7. More specifically, since picatinny rails include mounting platforms having a raised platform with inward angled outer edges, hooked edges 208 can be structured and configured to hook around, and secure underneath, the raised platform, as illustrated in FIG. 10. Therefore, hooked edges 208 may be shaped like a hook such that they include a bottommost portion that extends inward toward a center of base mount 202. In this manner, the space between the topmost portions of left and right hooked edges 208 is wider than the space between the bottommost portions. In some cases, hooked edges 208 are part of first side 116 and second side 220. Therefore, when first side 216 is tightened toward second side 220, hooked edges 208 can slide into the open space on a picatinny rail created by the inward angled outer edges of the raised platform.

Similar to base mount 102, base mount 202 may also include track guides 210. Track guides 210, as illustrated in FIGS. 7-8, can be located on opposite sides of base mount 202 and can have openings that engage with track 104 through, for example, a sliding mechanism. As mentioned above, the right and left sides of track 104 may include front and back rails 120, 122 having gutter 124 in between the two rails. And similar to base mount 102, each track guide 210 of base mount 202 may include vertical slot 224 that is sized to fit rear rails 122 such that when the rail engages with the vertical slot, it is secured in place via a friction fit. Therefore, in use, the rear left and rear right rails 122 of track 104 can slide into vertical slots 224 of left and right track guides 210, respectively, as illustrated in FIGS. 7-8.

In some embodiments, to more securely attach track 104 to base mount 202, the base mount may include track attachment screw 212. Track attachment screw 212 can be horizontally and threadedly engaged with both base mount 202 and track 104. More specifically, base mount 202 can include a horizontal, threaded hole in its front portion or along its top portion and into its front portion, and track 104 can include a horizontal, threaded hole that runs from its back to its front. The horizontal, threaded hole of base mount 202 can align with the corresponding horizontal, threaded hole in track 104 when the base mount and the track are slidingly engaged, as described above. To fixedly secure base mount 202 and track 104 together after they are slidingly engaged, track attachment screw 212 can be inserted into the threaded hole of the base mount and into the threaded hole of the track, thereby locking the two components together.

In addition to base mount 102 or 202, firearm mount 100, 200 can include track 104. As illustrated in FIGS. 1-3 and 7-9, track 104 can be roughly rectangular and, in some embodiments, the track can include level 130 on or near a top portion, opening 132 along a middle portion, and front rails 120 and back rails 122 along the right and left sides of track 104, wherein the right and left sides each have gutter 124 in between the front and back rails. In some embodiments, as illustrated in FIG. 13, firearm mount 700 can include base mount 702 and track 704, and the track can be roughly rectangular and can include level 730 on or near a top portion and opening 732 along a middle portion.

Level 130 of track 104, and level 730 of track 704, can be positioned horizontally along a top portion of the track such that when the base mount and the level are mounted to an elongated portion of a firearm, the level can be referenced to ensure the device is properly positioned to assist with leveling the scope of the firearm. In some embodiments, the level is a standard bubble level that is tubular, transparent, incompletely filled with a liquid so as to allow for an air bubble to be trapped, and containing two circumferential lines that indicate when the level is on a flat surface by having the air bubble aligned between them. Level 130 or 730 may be positioned on top of track 104 or 704 or it may be secured in level housing 134 or 734 on the back or front of the track and near the track's top portion, as illustrated in FIGS. 1, 7, and 13.

Opening 132 of track 104 can be a longitudinal (for example, rectangular) gap having a width that is at least as wide as light projector 108 and narrower than at least a portion of scope saddle 106, as illustrated in FIGS. 1 and 7. The length or height of opening 132 can be approximately, or slightly less than, the distance from the horizontal, threaded hole of track 104 to the bottommost part of level 130 or level housing 134, as illustrated in FIGS. 4 and 10. The purpose of opening 132 is to allow light projector 108 to move with scope saddle 106 when the scope saddle is vertically adjusted to settle on scope 500, 600. More specifically, light projector 108 can be attached to a rear portion of scope saddle 106 by inserting through opening 132. To allow for various scope heights, opening 132 enables scope saddle 106 and light projector 108 to remain coupled as the scope saddle moves up and down along track 104.

In some embodiments, opening 732 of track 704 can be a longitudinal gap having a width that is narrower than at least a portion of scope saddle 706 and that can be either wider or narrower than light projector 708, as illustrated in FIG. 13. The length or height of opening 732 can be the majority, or entirety, of the height of track 704. The purpose of opening 732 is to allow light from light projector 708 to shine through track 704 and into scope 800. More specifically, light projector 708 can be attached to base mount 702 and can face toward track 704 such that when the light projector is activated, light from the light projector shines through opening 732 in the track.

As mentioned above, track 104 can removably attach to the base mount. For example, a rear of track 104 can attach to a front end of the base mount via slidable track guides that can be located on either side of the base mount. When attaching to a barrel, track 104 can attach to track guides 116 of base mount 102. When attaching to a picatinny rail, track 104 can attach to track guides 210 of base mount 202. In either version, track attachment screw 128, 212 can further secure track 104 to the base mount.

More specifically, and as described above, to attach track 104 to the base mount, the track may include front rails 120 and rear rails 122 along the left and right sides of the track, as illustrated in FIGS. 1 and 7. The rails 120, 122 may project outward from the sides of track 104 such that they may be right and left extensions of the rear and front faces of the track. The rails 120, 122 may extend along a portion of the length of track 104 or they may extend along the entirety of the track's length. For example, front rails 120, which engage with scope saddle 106, may extend from the top of the track to the bottom of opening 132, and rear rails 122, which engage with the base mount, may be approximately the height of the base mount starting from the bottom of the track. Alternatively, front rails 120 and rear rails 122 may extend from the top of track 104 all the way to the bottom. To prevent scope saddle 106 from sliding off the bottom of front rail 120, the front rail may include stopper 136. In some embodiments, the configuration of front rails 120 and rear rails 122 creates gutter 124 in between the two rails. Gutter 124 allows for the track guides and the sides of scope saddle mount 138 to wrap around rails 120, 122 for a more secure attachment. Once attached, base mount 102 and track 104 may be positioned perpendicular to each other.

As mentioned above, in addition to base mount 102 or 202 and track 104, firearm mount 100, 200 can be further comprised of scope saddle 106. Scope saddle 106 can have scope saddle mount 138 for interaction with the top of scope 500, 600 of a firearm. Scope saddle 106 can also have scope saddle faceplate 140 for interaction with the front of scope 500, 500. Used together, scope saddle mount 138 and scope saddle faceplate 140 can help align firearm mount 100, 200 on firearm for leveling scope 500, 600. In some embodiments, as illustrated in FIG. 13, firearm mount 700 can include base mount 702, track 704, and scope saddle 706. Scope saddle 706 can have a scope saddle mount for interaction with the top of scope 800 of a firearm and can also have a connector for mounting to track 704.

In some embodiments, scope saddle mount 138 can be a block having a flat top, perpendicular sides, and a triangular cutout on its bottom portion, as illustrated in FIGS. 2 and 8, wherein the apex of the triangular cutout can be the closest portion of the cutout to the flat top and can be centered on the scope saddle mount, and angled, interior faces 142 of the cutout can have ribs or grip points for engagement with scope 500, 600 of the firearm. The rear face of scope saddle mount 138 can have engagement hooks 144 with openings or slots for connecting to the front rail of track 104. Therefore, a back of scope saddle 106 can attach to a front of track 104. More specifically, as with the track guide, scope saddle mount 138 can include openings on opposite sides of the scope saddle mount for engaging with track 104 through, for example, a sliding mechanism. These openings can be vertical slots 146 that are sized to fit front rail 120 of track 104 such that when a front rail engages with a vertical slot, it is secured in place via a friction fit. Therefore, in use, the front left and front right rails of track 104 can slide into vertical slots 146 of left and right engagement hooks 144 of scope saddle mount 138, respectively, as illustrated in FIGS. 1 and 7. This configuration enables scope saddle 106 to be vertically adjustable on track 104 such that, when base mount 102 or 202 is attached to the elongated portion of firearm, the scope saddle can slide from an upper position to a lower position until it comes in contact with scope 500, 600 of the firearm, as illustrated in FIGS. 5 and 11.

As mentioned above, scope saddle 106 can also include scope saddle faceplate 140, which can connect between front track 104 and back of scope saddle mount 138. Scope saddle faceplate 140 can be relatively flat and can extend downward from scope saddle mount 138 such that it covers a lower portion of track 104 than the scope saddle mount does. Additionally, faceplate 140 can include an engagement keyhole through a center portion of the faceplate that runs from front to rear. The engagement keyhole can align with opening 132 in track 104 and is where light projector 108 can attach to scope saddle faceplate 140. In some embodiments, scope saddle faceplate 140 can have a flat front face, such that when angled, interior faces 142 of the cutout of scope saddle mount 138 are in contact and engaged with scope 500, 600 of the firearm, the scope saddle faceplate can make flush contact with the front lens of the scope.

Light projector 108 of firearm mount 100, 200 can be approximately cylindrical and can include light projector focus 148 and ribbed collar 150. Light projector focus 148 can both produce a light, for example, with a light bulb, as well as control the light through electronics and a focusing mechanism. For example, light projector focus 148 can have an on/off control to turn the light on and off and can have controls/settings to make the light brighter or dimmer. In this manner, light projector 108 can shine and control a light through the front of scope 800 and out through the back where the eyepiece is attached, thereby projecting an image of scope reticle out from the eyepiece of the firearm. Additionally, in some embodiments, light projector focus 148 can be rechargeable using a micro-USB cable. In addition to producing the light, light projector focus 148 can also focus the light through physical means such as pulling, pushing, and rotating the housing of the light projector focus.

To connect light projector focus 148 securely to scope saddle 106, light projector 108 can connect to ribbed collar 150 using insertion means. More specifically, an interior circumference of ribbed collar 150 may be substantially similar but slightly larger than the exterior circumference of light projector focus 148 so that when the light projector focus is inserted into the ribbed collar, a friction fit is created. In another embodiment, the interior of ribbed collar 150 may be threaded and the exterior of the front portion of light projector focus 148 may be similarly threaded so as to enable a threaded connection between the ribbed collar and the light projector focus.

In some embodiments, as mentioned above, ribbed collar 150 of light projector 108 can attach to the engagement keyhole of scope saddle 106 through opening 132 in track 104. Connection may be a twist lock, such that ribbed collar 150 has keyed projections that extend out from its circumference and the engagement keyhole may have projection keyholes through which the keyed projections can pass. Ribbed collar 150 can then be twisted so that the keyed projections rotate past projection keyholes and onto a ledge, thereby locking the light projector 108 onto scope saddle 106 by preventing keyed projections from unintentionally reversing direction out and away from the scope saddle.

In some embodiments, light projector 708 can mount directly to base mount 702, as illustrated in FIG. 14, and can project light through track 704 and into the front of scope 800 and out through the back where the eyepiece is attached, thereby projecting an image of scope reticle out from the eyepiece of the firearm. As illustrated in FIG. 13, light projector 708 may attach to a rear part of base mount 702 and wrap up and around so that it faces toward a front of the base mount and scope 800 of the firearm. Base mount 702 may, therefore, house the electronics for controlling light projector 708 and may include the on/off switch.

Firearm mount, comprised of a base mount, track, scope saddle, and light projector, which can be connected to each other in the various, above-described manners, can connect to the elongated portion of a firearm such as, but not limited to, a barrel or picatinny rail. Once the firearm mount is connected, the light projector can be activated, thereby shining light through the scope of the firearm in the reverse direction (i.e., from the front of the scope out through the back where the eyepiece is attached), as illustrated in FIGS. 6, 12, and 14. While the light can be shone on any perpendicular surface, in some embodiments, an associated tripod and alignment grid can be used for additional precision leveling.

More specifically, alignment grid 400 can be attached to a top of tripod 300, as illustrated in FIG. 15, and the tripod can be placed on the same flat work surface as the firearm to allow for consistency on leveling platforms. Alignment grid 400 can be oriented to face the eyepiece of the firearm and can be vertically adjusted so that it maintains the same height as the scope and eyepiece of the firearm.

In some embodiments, tripod 300 can include legs 302 and mounting receiver 304, as illustrated in FIG. 15. Legs 302 can be telescoping legs to allow for variations in height of the firearm since it can be mounted to vises and/or working tools of different dimensions. The adjustability of legs 302 can also help level mounting receiver 304 so that it does not tilt in any one direction. Mounting receiver 304 can be ball joint 306 with male connector 308 and side mounted set screw 310 for adjusting the ball joint, and the ball joint can comprise a ball in a ball housing, wherein the ball housing mostly or completely encompasses the ball. To hold the ball in place within the ball housing, side mounted set screw 310 can insert through the housing and apply pressure directly against the ball within the ball housing. Therefore, the housing may have a threaded hole so that side mounted set screw 310, which can also be threaded, can effectively lock in place. Projecting from a surface of the ball out from the ball housing may be male connector 308, which may be a screw or other threaded or partially threaded protrusion. It is male connector 308 that can engage with alignment grid 400.

Alignment grid 400 can be rectangular with front and back flat faces 402, and either or both faces can include a cross-hatching pattern, as illustrated in FIG. 16. The cross-hatching pattern on front and/or back flat faces 402 of alignment grid 400 can be colored, for example red or any other non-black color, to differentiate the grid from the reticle projection, which is typically black. Alignment grid 400 can also include level 404 and female connector 406, as illustrated in FIG. 16, that can be compatible with male connector 308 of tripod 300. Level 404 can be located at a top portion of alignment grid 400 either on the top surface of the alignment grid or connected on a face of the alignment grid near the top surface, and female connector 406 can be located at bottom of alignment grid 400. To be compatible with male connector 308 if the connector is a threaded screw or other type of threaded or partially threaded projection, female connector 406 may have internal threading.

Therefore, when male connector of tripod 300 and female connector 406 of alignment grid 400 are threadedly connected, the alignment grid can be leveled through adjustment of ball joint 306 and the accuracy of the level can be confirmed through the use of level 404. More specifically, side mounted set screw 310 can be loosened to allow movement of ball joint 306 and alignment grid 400 (due to the connection between male connector 308 and female connector 406). Alignment grid 400 can be moved forward, backward, or twisted until front or back flat face 402 is level and facing the firearm. Side mounted set screw 310 can then be tightened to lock ball joint 306 and alignment grid 400 in place. Prior to leveling alignment grid 400, and as mentioned above, tripod legs 302 can be extended or retracted to position alignment grid 400 within the light projected from light projector 108. Therefore, between the height adjustment of tripod legs 302 and the leveling features such as ball joint 306 of mounting receiver 304 and level 404, the combined tripod 300 and alignment grid 400 can be positioned directly behind firearm and in the stream of light from light projector 108.

In an example use case, an individual can attach track 104 to base mount 102 or 202 by sliding the left and right rear track rails 122 into vertical slots 126 or 224 of the base mount. Base mount 102 or 202 can then be secured to an elongated portion of a firearm in front of firearm scope 500, 600. For example, base mount 102 can be secured to a barrel using a magnetized engagement between the barrel and pairs of magnets 112*a*, 112*b* in rear magnet housing and track guides. In another example, base mount 202 can be secured to a picatinny rail using a mechanical engagement between side clamp screw 206 and the picatinny rail, wherein the side clamp screw pulls together two opposing sides of the base mount to secure the base mount to the rail. In some embodiments, prior to or after securing base mount 102 or 202 to the firearm, the firearm can be leveled using level 130 attached to a top of track 104. Once base mount 102 or 202 is secured to the firearm, scope saddle 106 can be lowered along track 104 until angled, interior faces 142 of scope saddle mount 138 engage an outer diameter of scope 500, 600 of the firearm, thereby aligning light projector 108 with the front of the scope. The individual can then activate light projector 108, which may be attached to scope saddle 106 and aligned with a front of scope 500, 600 of the firearm, in order to project an image of a scope reticle out through an eyepiece of the scope. In some embodiments, light projector 108 can include light projector focus 148 and ribbed collar 150, wherein the ribbed collar attaches to scope saddle 106 and wherein the angle of light projected through the eyepiece of scope 500, 600 can be adjusted by pushing, pulling, and rotating the light projector focus.

To set up the rest of the reticle leveling system, the individual can attach alignment grid 400 to a top of tripod 300 and level the alignment grid by referencing level 404 near a top of the alignment grid and using the features described above. In addition to leveling alignment grid 400, the individual can align the image of the scope reticle on front or back flat face 402 of the alignment grid and rotate the scope to match the reticle lines of the scope with the graph lines on the face. More specifically, the reticle lines of the scope are aligned with the graph lines on front or back flat face 402 when they overlay each other. Once the reticle lines of the scope are aligned with the graph lines on front or back flat face 402, the individual can tighten the scope rings and lock the leveled scope in place.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

What is claimed is:

1. A reticle leveling system comprising:

a base mount structured and configured to mount to a firearm;

a track removably attached to the base mount, the track having a level;

a scope saddle that is vertically adjustable on the track; and a light projector attached to one of the scope saddle or the base mount.

2. The reticle leveling system of claim 1, wherein a back of the track is attached to a front end of the base mount, a back of the scope saddle is attached to the front of the track, and the light projector attaches to the scope saddle through an opening in the track.

3. The reticle leveling system of claim 1, wherein the light projector includes a light projector focus, and wherein an angle of light from the light projector is adjustable by manipulation of the light projector focus.

4. The reticle leveling system of claim 1, wherein the base mount includes at least one pair of magnets located on an underside of the base mount.

5. The reticle leveling system of claim 4, wherein the at least one pair of magnets are located on opposing sides of a rear magnet housing on the underside of the base mount.

6. The reticle leveling system of claim 4, wherein the base mount includes two pairs of magnets located on the underside of the base mount, the first pair being located at a first end of the base mount and the second pair being located at a second, opposite end of the base mount.

7. The reticle leveling system of claim 1, wherein the base mount includes a side clamp screw.

8. The reticle leveling system of claim 1, wherein the track is removably attached to the base mount using slidable track guides on either side of the base mount.

9. The reticle leveling system of claim 1, wherein the scope saddle is slidable vertically up and down the track.

10. The reticle leveling system of claim 9, wherein the scope saddle includes a scope saddle mount that is a block having a triangular cutout on its bottom portion, the triangular cutout having angled, interior faces.

11. The reticle leveling system of claim 10, wherein the scope saddle also includes a scope saddle faceplate that is positioned between the track and the scope saddle mount.

12. The reticle leveling system of claim 11, wherein the base mount further includes a rear height adjustment screw that enables a rear end of the base mount to vertically adjust.

13. The reticle leveling system of claim 1, further comprising:

a tripod; and an alignment grid attachable to a top of the tripod.

14. The reticle leveling system of claim 13, wherein the alignment grid includes cross-hatching in a color other than black.

15. A reticle leveling system comprising:

a base mount structured and configured to mount to an elongated portion of a firearm;

a track removably attached to a front end of the base mount, the track having a level;

a scope saddle that is slidingly adjustable along a vertical portion of the track; and a light projector attached to the scope saddle through an opening in the track.

16. A method of leveling a scope of a firearm, the method comprising:

attaching a track to a base mount;

securing the base mount to an elongated portion of the firearm;

sliding a scope saddle along the track until the scope saddle engages an outer diameter of the scope of the firearm; and activating a light projector that is attached to the scope saddle and aligned with a front of the scope of the firearm to project an image of a scope reticle out through an eyepiece of the scope.

17. The method of claim 16, the method further comprising:

leveling the firearm using a level attached to a top of the track;

attaching an alignment grid to a top of a tripod;

leveling the alignment grid using a second level attached to a top of the alignment grid;

aligning the image of the scope reticle on the alignment grid; and rotating the scope to match reticle lines of the scope reticle with graph lines on the alignment grid.

18. The method of claim 16, wherein the elongated portion of a firearm is a barrel and a bottom of the base mount includes at least one pair of magnets to secure the base mount to the barrel.

19. The method of claim 16, wherein the elongated portion of a firearm is a rail and the base mount includes a side clamp screw that pulls together two opposing sides of the base mount to secure the base mount to the rail.

20. The method of claim 16, wherein the light projector includes a light projector focus and a ribbed collar, wherein the ribbed collar attaches to the scope saddle, and wherein the angle of light from the light projector is adjusted by pushing, pulling, and rotating the light projector focus.

* * * * *